US012185831B2

(12) United States Patent
Xu

(10) Patent No.: US 12,185,831 B2
(45) Date of Patent: Jan. 7, 2025

(54) FOLDING FRAME AND OUTDOOR TABLE OR OUTDOOR CHAIR USING THE FOLDING FRAME

(71) Applicant: Dahai Xu, Dongguan (CN)

(72) Inventor: Dahai Xu, Dongguan (CN)

( * ) Notice: Subject to any disclaimer, the term of this patent is extended or adjusted under 35 U.S.C. 154(b) by 310 days.

(21) Appl. No.: 17/694,554

(22) Filed: Mar. 14, 2022

(65) Prior Publication Data

US 2023/0232978 A1 Jul. 27, 2023

(30) Foreign Application Priority Data

Jan. 24, 2022 (CN) ..... 202220193833.4

(51) Int. Cl.
*A47B 3/087* (2006.01)
*A47B 3/091* (2006.01)

(52) U.S. Cl.
CPC ..... *A47B 3/087* (2013.01); *A47B 3/0912* (2013.01); *A47B 3/0918* (2013.01)

(58) Field of Classification Search
CPC ..... A47C 4/286; A47B 3/087; A47B 3/0912; A47B 3/0918
See application file for complete search history.

(56) References Cited

U.S. PATENT DOCUMENTS 10,010,179 B1 * 7/2018 Stump ..... A47C 4/44
11,700,943 B1 * 7/2023 Wang ..... A47C 4/286 297/16.2
2023/0172358 A1 * 6/2023 Xu ..... A47C 9/105 297/16.2
2023/0200539 A1 * 6/2023 Chen ..... A47C 3/18 297/47

FOREIGN PATENT DOCUMENTS

CN 210870581 U * 6/2020

* cited by examiner

*Primary Examiner* — Matthew W Ing

(57) ABSTRACT

A folding frame and an outdoor table or outdoor chair using the folding frame. The folding frame comprises a base, a plurality of support legs hinged around the base, a plurality of extension support bars hinged on the support legs and capable of folding, and a locking mechanism. The base is provided with a plurality of gear racks. Both sides of each gear rack are configured with vertically distributed first teeth part. Both sides of the upper end of the support leg are configured with circularly distributed second teeth part. The upper end of the support leg is positioned between two gear racks, and the second teeth part of the support leg mesh with the first teeth part of the gear rack. When the locking mechanism can lock the unfolded support legs, the gear rack also locks the support legs.

15 Claims, 6 Drawing Sheets

FOLDING FRAME AND OUTDOOR TABLE OR OUTDOOR CHAIR USING THE FOLDING FRAME

BACKGROUND OF INVENTION

1. Field of the Invention

The present invention relates generally to the technical field of outdoor products, and more particularly to a folding frame and an outdoor table and outdoor chair using the folding frame.

2. Description of Related Art

Nowadays, along with economic development, urban people are having more outdoor activities to satisfy their spiritual demands and to relax themselves from the stressful working environment. When traveling out for fishing, camping, or gathering, people usually carry portable folding outdoor tables or outdoor chairs.

However, the outdoor tables and outdoor chairs in the current market are simple and the overall structure is not strong enough. Moreover, they have limited folding capability and are inconvenient to use.

In view of this, the following technical solution is proposed.

SUMMARY OF THE INVENTION

The purpose of the present invention is to overcome the deficiencies of the prior art, and to provide a folding frame and an outdoor table and outdoor chair using the folding frame.

In order to solve the above-mentioned technical problems, the present invention adopts the following first technical scheme:

A folding frame, comprising: a base, a plurality of support legs hinged around the base, a plurality of extension support bars hinged on the support legs and capable of folding in relation to the support legs, a locking mechanism mounted inside the base and capable of locking the unfolded support legs, and a plurality of gear racks fitted inside the base, wherein each gear rack is configured with vertically distributed a first teeth part on both sides, an upper end of the support leg is configured with circularly distributed a second teeth part on both sides, the upper end of the support leg is positioned between two gear racks, the second teeth part of the support leg mesh with the first teeth part of the gear rack, each support leg can be folded and unfolded independently in relation to the base.

More particularly, wherein the cross section of the gear rack is in the shape of a right angle.

More particularly, wherein the locking mechanism includes a pull rod mounted inside the base, capable of moving up and down, a spring sheathed outside the pull rod and abutting the base, and a plurality of locking blocks hinged inside the base and flexibly connected to the outside of the upper end of the pull rod, the pull rod is pushed upward under the elastic force of the spring, to force the end portion of the locking block into lock slot on the upper end of the support leg, so as to provide fixation support to the support legs unfolded in relation to the base, the lower end of the pull rod is extended out of the lower end face of the base, by pulling the pull rod downward to force the locking block to leave the lock slot on the upper end of the support leg, the locking can be released.

More particularly, wherein both sides of the locking block are formed with a round convex column, and the locking block is hinged with the base through the round convex columns, capable of swinging up and down inside the base.

More particularly, wherein the end portion of the locking block is configured with a hinge slot, and both sides of the locking block are configured with a slide bar hole that goes through the hinge slot, the outside of the upper end of the pull rod is configured with a plurality of hinge portions, the side face of the hinge portion is configured with a through axle hole, the hinge portion is mounted inside the hinge slot on the end portion of the locking block, the axle hole of the hinge portion is fitted with a shaft, the end portion of the shaft goes into the slide bar hole, and can slide inside the slide bar hole.

More particularly, wherein the lower end of the pull rod is configured with a flexible pull ring, the lower end face of the base is configured with sphere surface slots, the upper end of the pull ring is configured inside the sphere surface slots, and abuts the sphere surface slots.

More particularly, the base comprises a base seat and a cover plate covering the base seat, the base seat is configured with a main mounting slot extending from its upper end face downward for mounting the pull rod and a plurality of first branch mounting slots and second branch mounting slots located outside the main mounting slot, the pull rod is fitted inside the main mounting slot, the locking block is hinged inside the first branch mounting slots, the outside of the base seat is configured with a plurality of intercommunicating holes that are both communicated to the first branch mounting slots and the second branch mounting slots, the gear rack goes through the second branch mounting slots, the first teeth part of the gear rack is exposed inside the hole, and the cover plate covers the upper end of the gear rack, the upper end of the support leg is hinged inside the hole through the pin shaft, the bottom of the main mounting slot is further configured with a sink slot, the spring is installed inside the sink slot.

More particularly, wherein the number of the support legs is four, each support leg is hinged with an extension support bar, and the support leg has a containing groove to contain the retracted extension support bar.

In order to solve the above-mentioned technical problems, the present invention adopts the following second technical scheme:

An outdoor chair, comprising: a folding frame and a chair cloth configured on an upper end of the folding frame, wherein the folding frame includes a base, a plurality of support legs hinged around the base, a plurality of extension support bars hinged on the support legs and capable of folding in relation to the support legs, a locking mechanism mounted inside the base and capable of locking the unfolded support legs, and a plurality of gear racks fitted inside the base, each gear rack is configured with vertically distributed first teeth part on both sides, the upper end of the support leg is configured with circularly distributed second teeth part on both sides, the upper end of the support leg is positioned between two gear racks, the second teeth part of the support leg mesh with the first teeth part of the gear rack, each support leg can be folded and unfolded independently in relation to the base, the number of support legs is four, the number of the extension support bars is four, wherein two bars are long extension bars, and the other two bars are short extension bars, the chair cloth is in the shape of a hopper, and the four corners of the chair cloth are respectively connected to and fixed with the upper ends of the four extension bars.

More particularly, wherein the section of the gear rack is in the shape of a right angle, wherein the locking mechanism comprises a pull rod mounted inside the base, capable of moving up and down, a spring sheathed outside the pull rod and abutting the base, and a plurality of locking blocks hinged inside the base and flexibly connected to the outside of the upper end of the pull rod, the pull rod is pushed upward under the elastic force of the spring, to force the end portion of the locking block into lock slot on the upper end of the support leg, so as to provide fixation support to the support legs unfolded in relation to the base, the lower end of the pull rod is extended out of the lower end face of the base, by pulling the pull rod downward to force the locking block to leave the lock slot on the upper end of the support leg, the locking can be released.

More particularly, wherein both sides of the locking block are formed with a round convex column, and the locking block is hinged with the base through the round convex columns, and can swing up and down inside the base, the lower end of the pull rod is configured with a flexible pull ring, the lower end face of the base is configured with sphere surface slots, the upper end of the pull ring is configured inside the sphere surface slots, and abuts the sphere surface slots.

More particularly, wherein the end portion of the locking block is configured with a hinge slot, and the two sides of the locking block are configured with a slide bar hole that goes through the hinge slot, the outside of the upper end of the pull rod is configured with a plurality of hinge portions, the side face of the hinge portion is configured with a through axle hole, the hinge portion is mounted inside the hinge slot on the end portion of the locking block, the axle hole of the hinge portion is fitted with a shaft, the end portion of the shaft goes into the slide bar hole, and can slide inside the slide bar hole.

More particularly, wherein the base comprises a base seat and a cover plate covering the base seat, the base seat is configured with a main mounting slot extending from its upper end face downward for mounting the pull rod and a plurality of first branch mounting slots and second branch mounting slots located outside the main mounting slot, the pull rod is fitted inside the main mounting slot, the locking block is hinged inside the first branch mounting slots, the outside of the base seat is configured with a plurality of intercommunicating holes that are both communicated to the first branch mounting slots and the second branch mounting slots, the gear rack goes through the second branch mounting slots, the first teeth part of the gear rack is exposed inside the hole, and the cover plate covers the upper end of the gear rack, the upper end of the support leg is hinged inside the hole through the pin shaft, the bottom of the main mounting slot is further configured with a sink slot, the spring is installed inside the sink slot.

In order to solve the above-mentioned technical problems, the present invention adopts the following third technical scheme:

An outdoor table, comprising: a folding frame and a table cloth configured on the upper end of the folding frame, wherein the folding frame includes a base, a plurality of support legs hinged around the base, a plurality of extension support bars hinged on the support legs and capable of folding in relation to the support legs, a locking mechanism mounted inside the base and capable of locking the unfolded support legs, and a plurality of gear racks are fitted inside the base, each gear rack is configured with vertically distributed first teeth part on both sides, the upper end of the support leg is configured with circularly distributed second teeth part on both sides, the upper end of the support leg is positioned between two gear racks, the second teeth part of the support leg mesh with the first teeth part of the gear rack, each support leg can be folded and unfolded independently in relation to the base; the number of support legs is four, the number of the extension support bars is four, their lengths are the same, the four corners of the table cloth are respectively connected to and fixed with the upper ends of the four extension bars through the connecting blocks.

More particularly, wherein the section of the gear rack is in the shape of a right angle, wherein the locking mechanism comprises a pull rod mounted inside the base, capable of moving up and down, a spring sheathed outside the pull rod and abutting the base, and a plurality of locking blocks hinged inside the base and flexibly connected to the outside of the upper end of the pull rod, the pull rod is pushed upward under the elastic force of the spring, to force the end portion of the locking block into lock slot on the upper end of the support leg, so as to provide fixation support to the support legs unfolded in relation to the base, the lower end of the pull rod is extended out of the lower end face of the base, by pulling the pull rod downward to force the locking block to leave the lock slot on the upper end of the support leg, the locking can be released.

More particularly, wherein both sides of the locking block are formed with a round convex column, and the locking block is hinged with the base through the round convex columns, and can swing up and down inside the base, the lower end of the pull rod is configured with a flexible pull ring, the lower end face of the base is configured with sphere surface slots, the upper end of the pull ring is configured inside the sphere surface slots, and abuts the sphere surface slots.

More particularly, wherein the end portion of the locking block is configured with a hinge slot, and the two sides of the locking block are configured with a slide bar hole that goes through the hinge slot, the outside of the upper end of the pull rod is configured with a plurality of hinge portions, the side face of the hinge portion is configured with a through axle hole, the hinge portion is mounted inside the hinge slot on the end portion of the locking block, the axle hole of the hinge portion is fitted with a shaft, the end portion of the shaft goes into the slide bar hole, and can slide inside the slide bar hole.

More particularly, wherein the base comprises a base seat and a cover plate covering the base seat, the base seat is configured with a main mounting slot extending from its upper end face downward for mounting the pull rod and a plurality of first branch mounting slots and second branch mounting slots located outside the main mounting slot, the pull rod is fitted inside the main mounting slot, the locking block is hinged inside the first branch mounting slots, the outside of the base seat is configured with a plurality of intercommunicating holes that are both communicated to the first branch mounting slots and the second branch mounting slots, the gear rack goes through the second branch mounting slots, the first teeth part of the gear rack is exposed inside the hole, and the cover plate covers the upper end of the gear rack, the upper end of the support leg is hinged inside the hole through the pin shaft, the bottom of the main mounting slot is further configured with a sink slot, the spring is installed inside the sink slot.

Comparing with the prior art, the present invention has the following effects and benefits:

The folding frame of the present invention features the addition of a locking mechanism and gear racks. Specifically, the upper end of the support leg is positioned between two gear racks. The second teeth part of the support leg mesh with the first teeth part of the gear rack. Each support leg can be folded and unfolded independently in relation to the base. In operation, when the locking mechanism can lock the unfolded support leg, the gear rack also locks the support leg to avoid unexpected folding of the support leg and to guarantee safety of use. The gear rack also provides support to the support leg, so that the folding frame can be supported stably when it is unfolded and can provide stronger support. Moreover, with the addition of the gear racks, each support leg can be folded and unfolded independently. The support legs will not be driven by each other. This design can avoid failure of folding the whole frame because of one stuck support leg, and guarantee smooth folding of each support leg without interference and therefore provides more convenience.

DETAILED DESCRIPTION OF THE INVENTION

Figure 1:
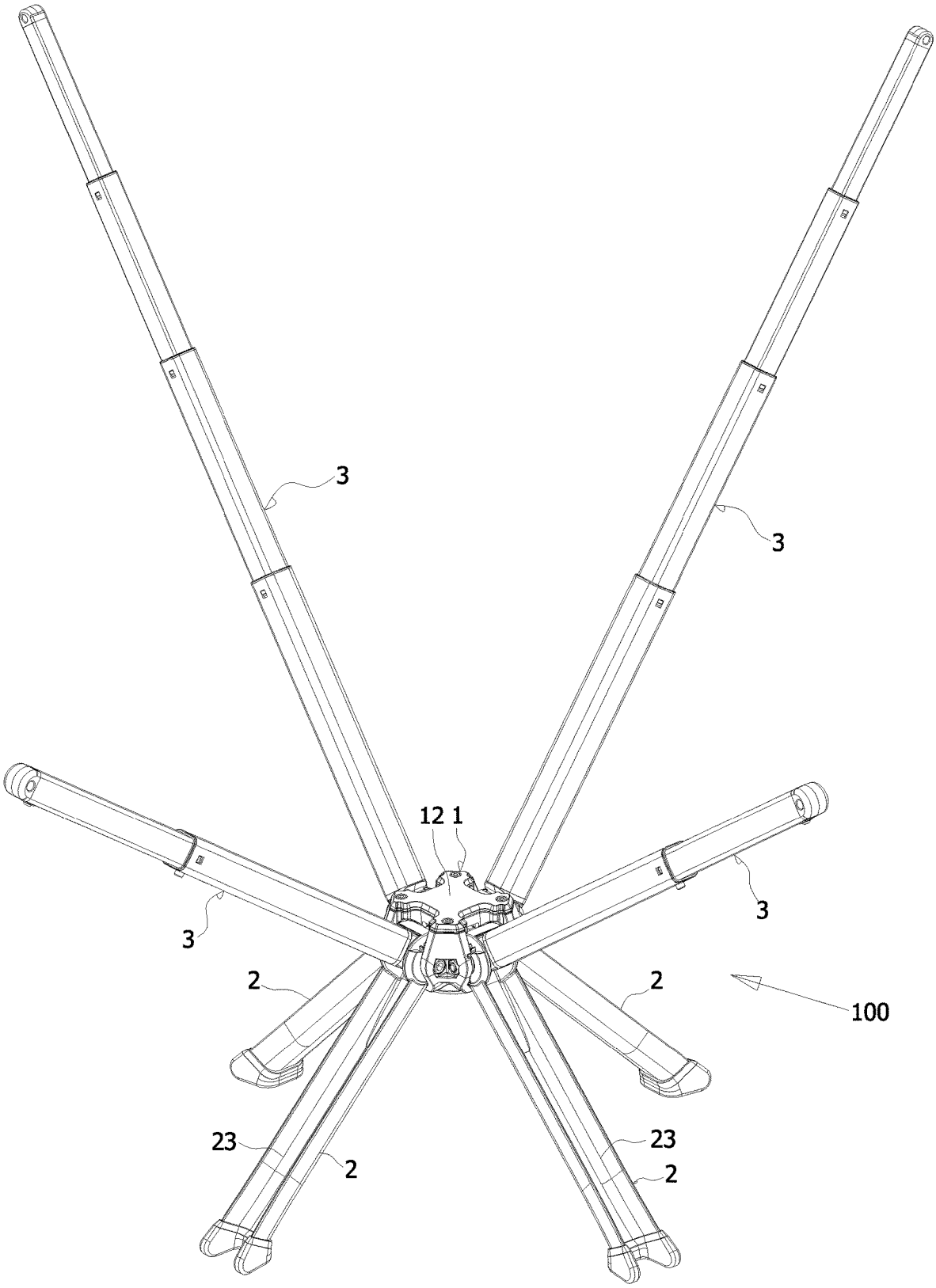
FIG. 1 is a perspective view of the folding frame of the present invention.
Figure 2:
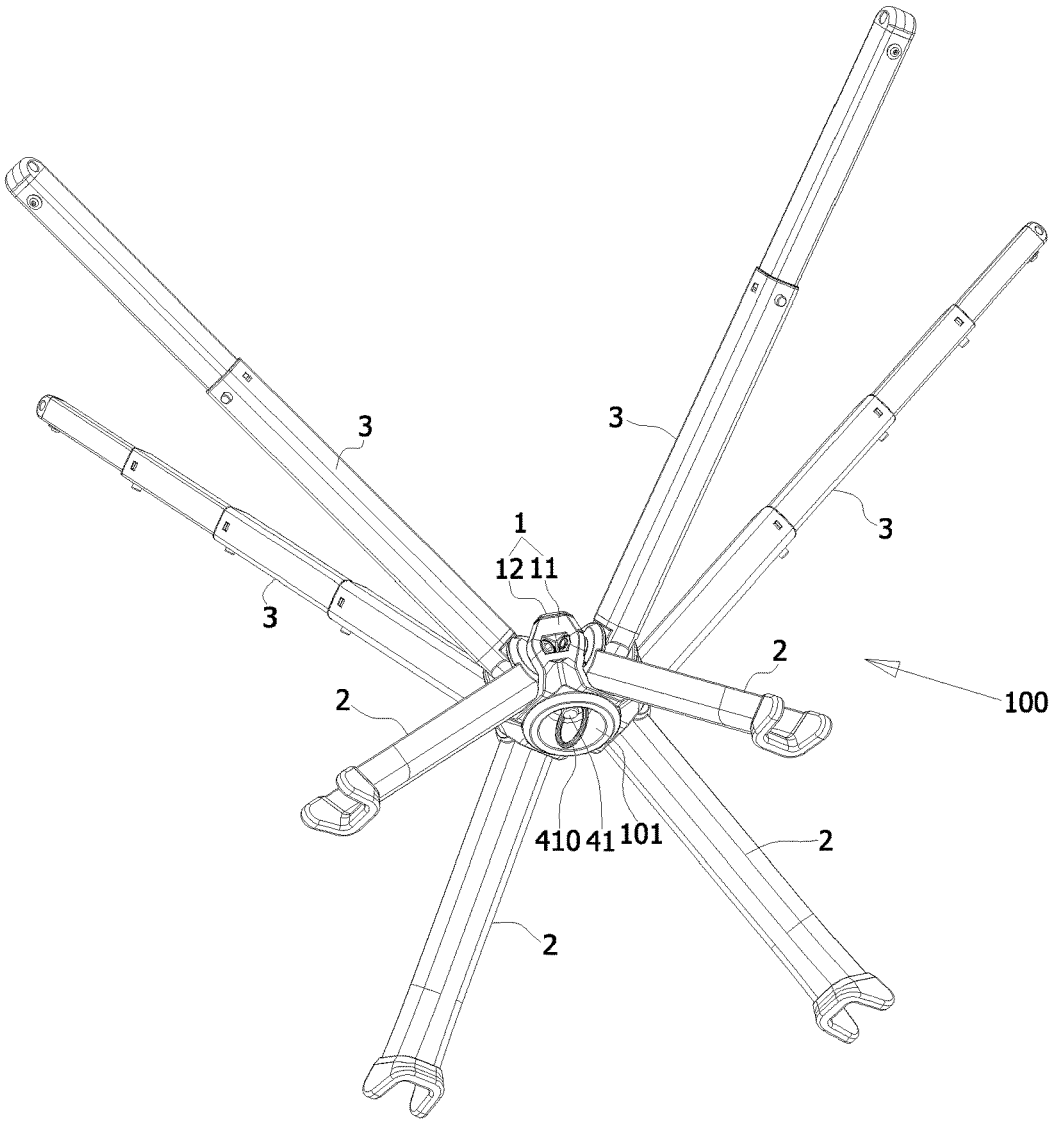
FIG. 2 is another perspective view of the folding frame of the present invention.
Figure 3:
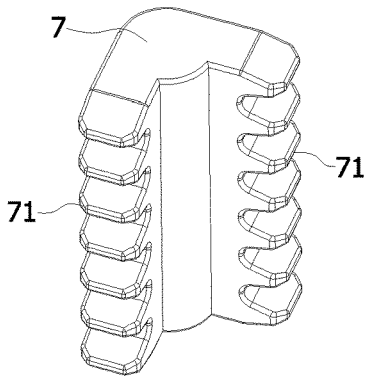
FIG. 3 is a perspective view of the gear rack of the present invention.
Figure 4:
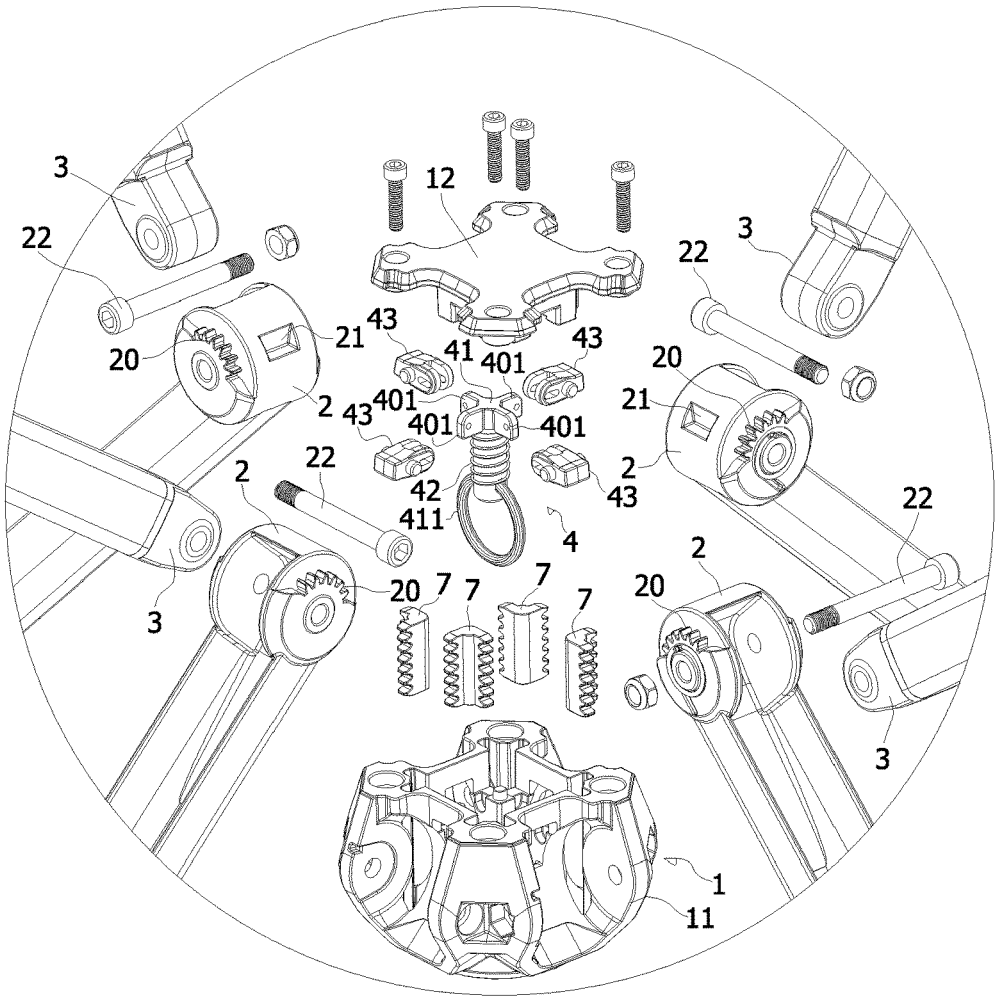
FIG. 4 is a perspective exploded view of the folding frame (partial) of the present invention.
Figure 5:
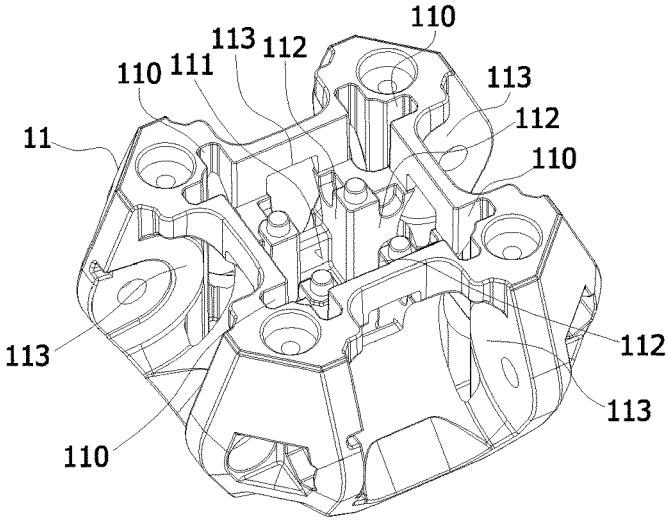
FIG. 5 is a perspective view of the base of the present invention.
Figure 6:
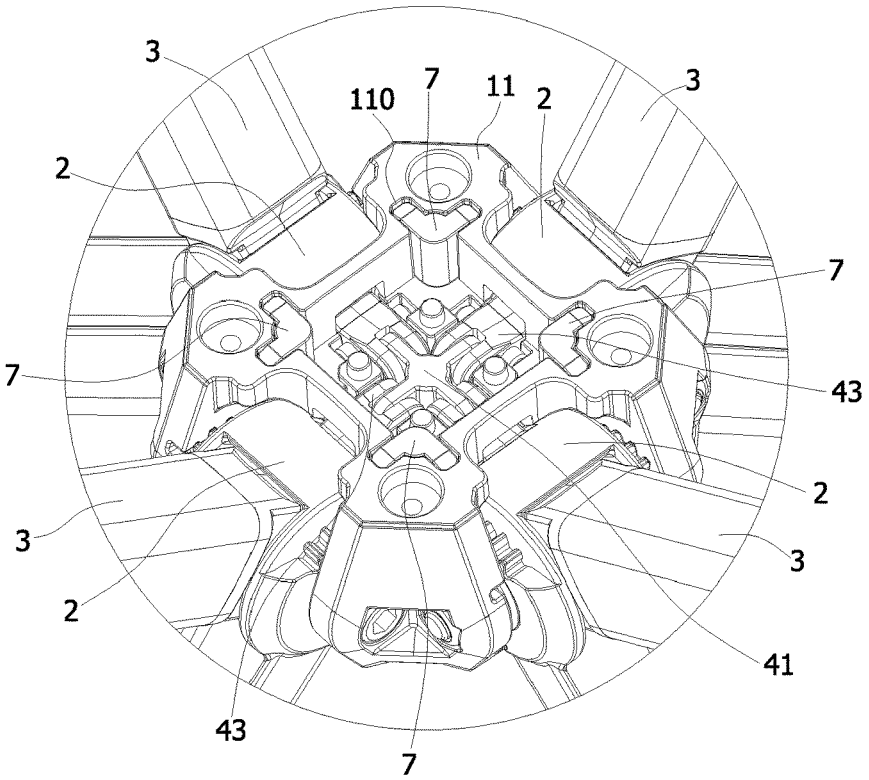
FIG. 6 is an internal structural view of the folding frame of the present invention.
Figure 7:
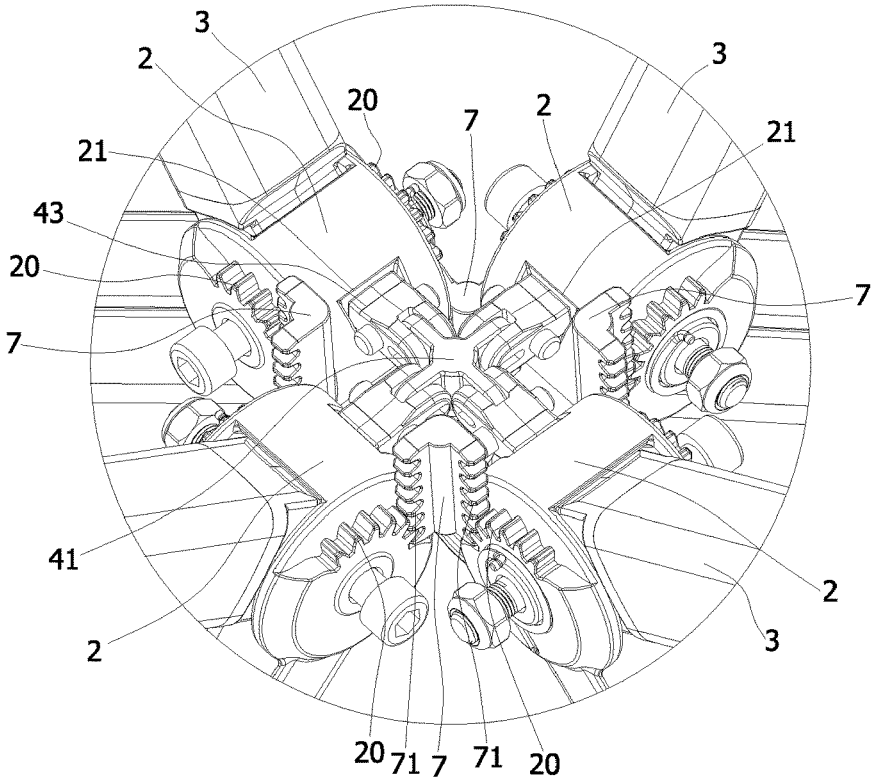
FIG. 7 is a structural view of FIG. 6 after disassembling the base seat.
Figure 8:
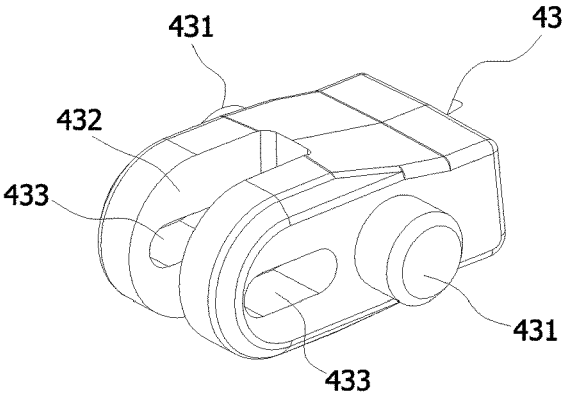
FIG. 8 is a perspective view of the locking block of the present invention.
Figure 9:
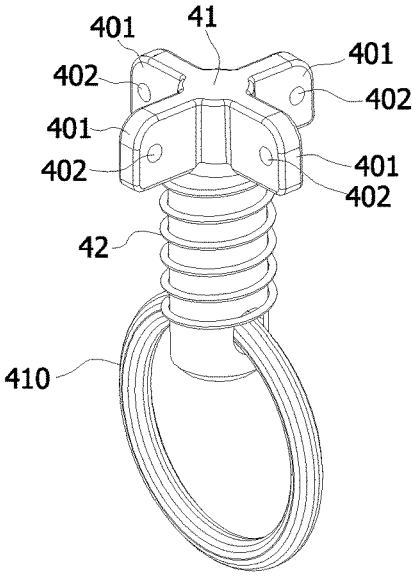
FIG. 9 is an assembly view of the pull rod and spring of the present invention.
Figure 10:
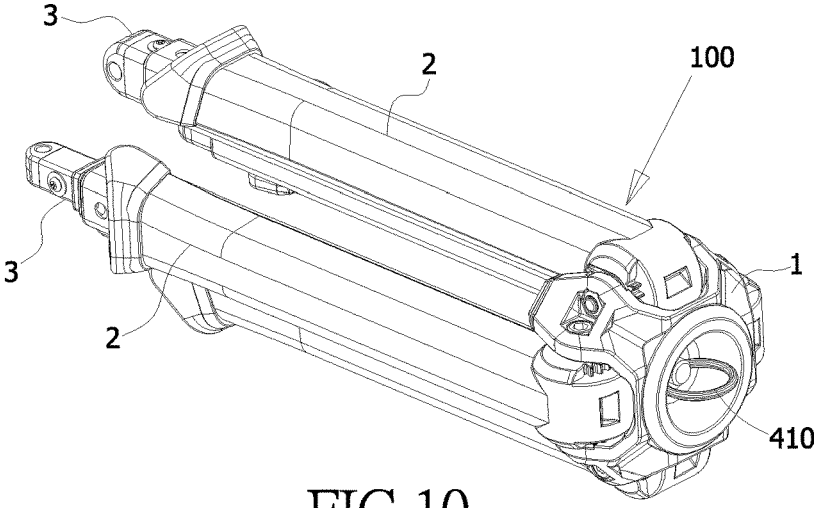
FIG. 10 is a state view of the present invention after the folding frame is folded.

Depicted in FIGS. 1-10 is a folding frame. The folding frame 100 comprises a base 1, a plurality of support legs 2 hinged around the base 1, a plurality of extension support bars 3 hinged on the support legs 2 and capable of folding in relation to the support legs 2, and a locking mechanism 4 mounted inside the base 1 and capable of locking the unfolded support legs 2. To use the frame, unfold the support leg 2 in relation to the base 1 to support the base 1, and unfold the extension support bars 3 in relation to the support legs 2 and extend them for support. Specifically, the locking mechanism 4 can lock the unfolded support legs 2 to avoid unexpected folding of the support legs 2 and guarantee safety of use. To fold the frame for storage, firstly unlock the locking mechanism 4 so that the extension support bars 3 can be retracted for folding. And then, the extension support bars 3 are folded in relation to the support legs 2. The support legs 2 are folded bottom up in relation to the base 1, so that the product size is reduced after folding for convenient transportation.

A plurality of gear racks 7 are fixed inside the base 1. Both sides of each gear rack 7 are configured with vertically distributed first teeth part 71. Both sides of the upper end of the support leg 2 are configured with circularly distributed second teeth part 20. The upper end of the support leg 2 is positioned between two gear racks 7, the second teeth part 20 of the support leg 2 mesh with the first teeth part 71 of the gear rack 7, and each support leg 2 can be folded and unfolded independently in relation to the base 1. During operation, when the locking mechanism 4 can lock the unfolded support legs 2, the gear rack 7 can also lock the support leg 2, so as to avoid unexpected folding of the support leg 2, and guarantee safety of use. The gear rack 7 also provides support to the support leg 2, so that the folding frame is stably supported after unfolding, and can provide stronger support. Moreover, with the addition of the gear racks 7, each support leg 2 can be folded and unfolded independently in relation to the base 1. The support legs 2 are not linked to each other, and will not be driven by each other. This design can avoid failure of folding the whole frame due to one stuck support leg 2, and can guarantee smooth folding of each support leg 2 without interference and convenient use.

The section of the gear rack 7 is in the shape of a right angle. Thus the gear rack 7 can touch and mesh with the two neighboring support legs 2 through the vertically distributed first teeth part 71 on both sides, while ensuring smooth folding of each support leg 2, no interference and convenient use.

When the support legs 2 are unfolded in relation to the base 1, the support legs 2 are fixed inside the base 1 through the locking mechanism 4 to avoid unexpected retraction of the support legs 2 in relation to the base 1 to guarantee safety of use, and to guarantee stable support of the folding frame to provide strong support. Specifically, the locking mechanism 4 comprises a pull rod 41 mounted inside the base 1, capable of moving up and down, a spring 42 configured outside the pull rod 41 and abutting the base 1, and a plurality of locking blocks 43 hinged inside the base 1 and flexibly connected to the outside of the upper end of the pull rod 41. The pull rod 41 is pushed upward under the elastic force of the spring 42 to force the end portion of the locking block 43 into the lock slot 21 of the upper end of the support leg 2, so as to guarantee stable fixation of the support leg 2 outside the base 1, and stable support provided by the support legs 2 unfolded in relation to the base 1. The lower end of the pull rod 41 is extended outside the lower end of the base 1. By pulling the pull rod 41 downward to force the end portion of the locking block 43 to leave the lock slot 21 on the upper end of the support leg 2, the locking can be released. At this point, the support leg 2 can be folded in relation to the base 1. The folding and unfolding of the folding frame are very easy, bringing great convenience to users.

The base 1 comprises a base seat 11 and a cover plate 12 covering the base seat 11, wherein, the cover plate 12 is locked with the base seat 11 through screws.

Specifically, the base 1 comprises a base seat 11 and a cover plate 12 covering the base seat 11. The base seat 11 is configured with a main mounting slot 111 extending from its upper end face downward for mounting the pull rod 41 and a plurality of first branch mounting slots 112 and second branch mounting slots 110 located outside the main mounting slot 111. The pull rod 41 is fitted inside the main mounting slot 111. The locking block 43 is hinged inside the first branch mounting slots 112. The outside of the base seat 11 is configured with a plurality of intercommunicating holes 113 communicated to the first branch mounting slots 112 and the second branch mounting slots 110. The gear rack 7 is fitted inside the second branch mounting slots 110. The first teeth part 71 of the gear rack 7 is exposed inside the hole 113. The cover plate 12 covers the upper end of the gear rack 7. The upper end of the support leg 2 is hinged inside the hole 113 through the pin shaft 22. Because the hole 113 is communicated to the second branch mounting slots 110, the second teeth part 20 of the support leg 2 can mesh with the first teeth part 71 of the gear rack 7. The bottom of the main mounting slot 111 is configured with a sink slot 114. The spring 42 is installed inside the sink slot 114. The upper end of the spring 42 abuts the pull rod 41. The lower end of the spring 42 abuts the bottom of the sink slot 114.

Both sides of the locking block 43 are formed with a round convex column 431, and the locking block 43 is hinged with the base 1 through the round convex column 431, and can swing up and down inside the base 1. Specifically, the round convex column 431 of the locking block 43 is hinged with the groove body configured on the inner wall of the branch mounting slots 112, so that the locking block 43 can swing up and down inside the base 1.

The end portion of the locking block 43 is configured with a hinge slot 432. The two sides of the locking block 43 are configured with a slide bar hole 433 going through the hinge slot 432. The outside of the upper end of the pull rod 41 is configured with a plurality of hinge portions 401. The side face of the hinge portion 401 is configured with a through axle hole 402. The hinge portion 401 is installed inside the hinge slot 432 on the end portion of the locking block 43. The axle hole 402 of the hinge portion 401 is fitted with a shaft. The end portion of the shaft goes through the slide bar hole 433, and can slide inside the slide bar hole 433. When the pull rod 41 is pushed upward under the elastic force of the spring 42, the hinge portion 401 drives the end portion of the locking block 43 to swing downward through the shaft, forcing the end portion of the locking block 43 into the lock slot 21 on the upper end of the support leg 2, thus realizing the locking function. When the pull rod 41 is pulled downward, the hinge portion 401 slides inside the slide bar hole 433 of the locking block 43 through the shaft, driving the end portion of the locking block 43 to swing upward within a sufficient space, so that the end portion of the locking block 43 leaves the lock slot 21 of the upper end of the support leg 2, thus realizing the unlocking function.

The lower end of the pull rod 41 is configured with a flexible pull ring 410. The lower end face of the base 1 is configured with sphere surface slots 101. The upper end of the pull ring 410 is configured inside the sphere surface slot 101 and abuts the sphere surface slot 101. When it is needed to fold up the folding frame 100, just pull down the pull ring 413 to release the locking state. The operation is very convenient.

The section of the upper end of the pull rod 41 is in the shape of a cross. The outside of the upper end of the pull rod 41 has a hinge portion 401 flexibly connected to the locking block 43.

The number of the support legs 2 is four. Each support leg 2 is hinged with an extension support bar 3. The support leg 2 has a containing groove 23 to contain the retracted extension support bar 3.

In summary, the folding frame of the present invention is additionally configured with a locking mechanism 4 and a gear rack 7. Specifically, the upper end of the support leg 2 is positioned between two gear racks 7. The second teeth part 20 of the support leg 2 mesh with the first teeth part 71 of the gear rack 7. Each support leg 2 can be folded and unfolded independently in relation to the base 1. In operation, when the locking mechanism 4 can lock the unfolded support legs 2, the gear rack 7 can also lock the support leg 2, so as to avoid unexpected folding of the support leg 2, and guarantee safety of use. Moreover, the gear rack 7 provides support to the support leg 2, so that the folding frame can be stably supported after unfolding to provide stronger support. Moreover, with the addition of the gear racks 7, each support leg 2 can be folded and unfolded independently in relation to the base 1. The support legs 2 will not be driven by each other. This design can avoid failure of folding the whole frame because of one stuck support leg 2, and guarantee smooth folding of each support leg 2 without interference and therefore provides more convenience.

Figure 11:
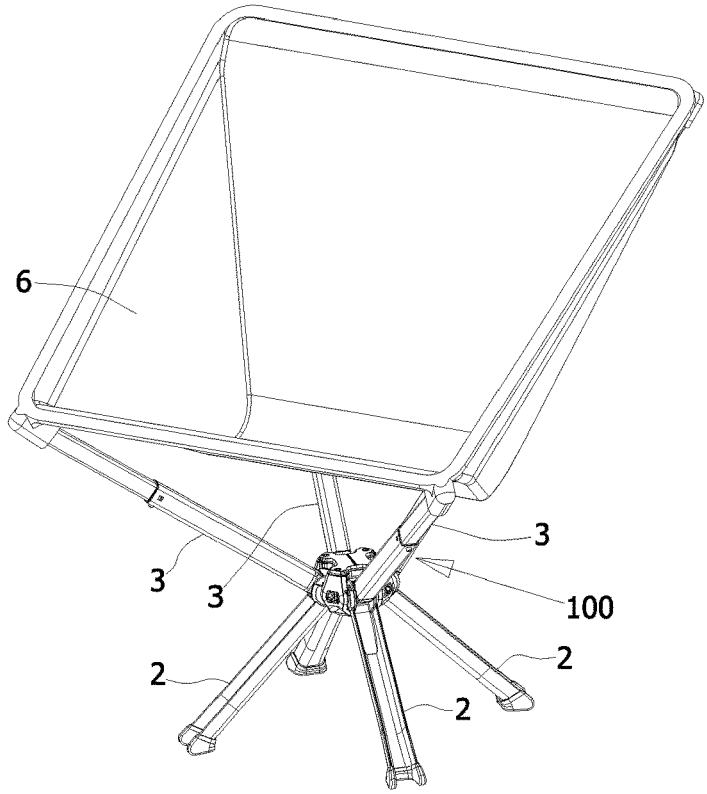
FIG. 11 is a perspective view of the outdoor chair according to the present invention.

Depicted in FIG. 11 is an outdoor chair, which comprises the above folding frame 100 and a chair cloth 6 configured on the upper end of the folding frame 100. The number of the support legs 2 is four. The number of the extension support bar 3 is four, wherein two bars are long extension bars, and the other two bars are short extension bars. The chair cloth 6 is in the shape of a hopper. The four corners of the chair cloth 6 are respectively connected to and fixed with the upper ends of the extension support bars 3.

As the folding frame 100 used by the outdoor chair has been clearly described above, it is not repeated herein. The outdoor chair features a simple structure and can be quickly and conveniently folded through the folding frame 100. The size after folding is small and is suitable for transportation.

Figure 12:
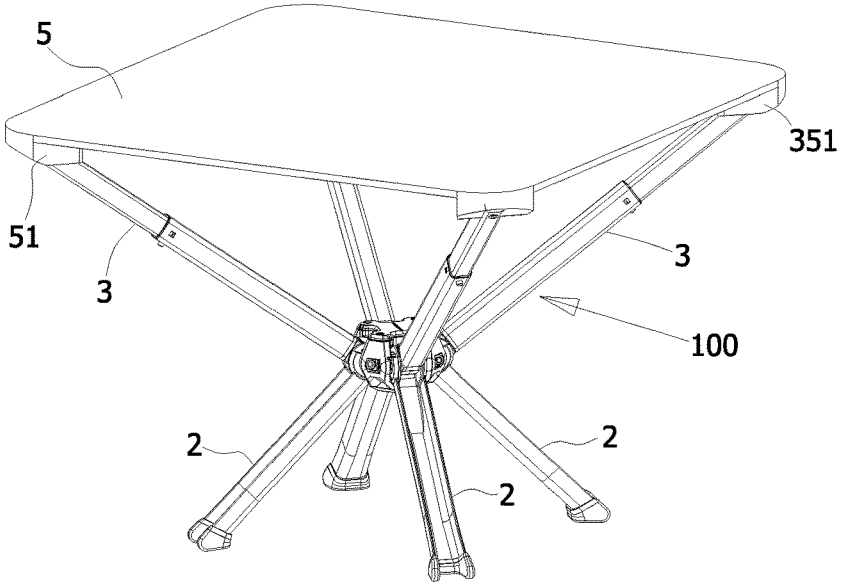
FIG. 12 is a perspective view of the outdoor table according to the present invention.

Depicted in FIG. 12 is an outdoor table, which comprises the above folding frame 100 and a table cloth 5 configured on the upper end of the folding frame 100. The number of the support legs 2 is four. The number of the extension support bars 3 is four. Their lengths are the same. The four corners of the table cloth 5 are connected to and fixed on the upper ends of the extension support bars 3 through the connecting blocks 51.

As the folding frame 100 used by the outdoor table has been clearly described above, it is not repeated herein. The outdoor table features a simple structure and can be quickly and conveniently folded through the folding frame 100. The size after folding is small and is suitable for transportation.

I claim:

1. A folding frame, comprising:

a base, a plurality of support legs hinged around the base, a plurality of extension support bars hinged on the plurality of support legs and capable of folding in relation to the plurality of support legs, a locking mechanism mounted within the base that can lock the plurality of support legs when unfolded, and a plurality of gear racks fitted inside the base, wherein each of the plurality of gear racks is configured with vertically distributed a first teeth part on both sides, an upper end of each of the plurality of support legs is configured with circularly distributed a second teeth part on both sides, the upper end of each of the plurality of support legs is positioned between two of the plurality of gear racks, the second teeth part on each of the plurality of the support legs engages with the first teeth part of each of the plurality of gear racks, each of the plurality of support legs can be folded and unfolded independently in relation to the base;

wherein the locking mechanism comprises a pull rod mounted inside the base, which can move up and down, a spring sheathed outside the pull rod and abutting the base, and a plurality of locking blocks hinged inside the base and flexibly connected to an outside of an upper end of the pull rod, the pull rod can be pushed upward under an elastic force of the spring, to force an end portion of each of the plurality of locking blocks into lock slot on the upper end of each of the plurality of support legs, so as to provide fixation support to the plurality of support legs unfolded in relation to the base, a lower end of the pull rod can be extended out of a lower end face of the base, by pulling the pull rod downward to force each of the plurality of locking blocks to leave the lock slot on the upper end of each of the plurality of support legs, the locking can be released.

2. The folding frame defined in claim 1, wherein each of the plurality of gear racks has a cross section that is in the shape of a right angle.

3. The folding frame defined in claim 1, wherein both sides of each of the plurality of locking blocks are formed with a round convex column, and each of the plurality of locking blocks is hinged with the base through the round convex columns, capable of swinging up and down inside the base.

4. The folding frame defined in claim 3, wherein the end portion of each of the plurality of locking blocks is configured with a hinge slot, and both sides of each of the plurality of locking blocks are configured with a slide bar hole that goes through the hinge slot, the outside of the upper end of the pull rod is configured with a plurality of hinge portions, a side face of each of the plurality of hinge portions is configured with a through axle hole, each of the plurality of hinge portions is mounted inside the hinge slot on the end portion of each of the plurality of locking blocks, the axle hole of each of the plurality of hinge portions is fitted with a shaft, an end portion of the shaft goes into the slide bar hole, and can slide inside the slide bar hole.

5. The folding frame defined in claim 1, wherein the lower end of the pull rod is configured with a flexible pull ring, the lower end face of the base is configured with sphere surface slots, an upper end of the pull ring is configured inside the sphere surface slots, and abuts the sphere surface slots.

6. The folding frame defined in claim 1, wherein the base comprises a base seat and a cover plate covering the base seat, the base seat is configured with a main mounting slot extending from the base seat's upper end face downward for mounting the pull rod and a plurality of first branch mounting slots and second branch mounting slots located outside the main mounting slot, the pull rod is fitted inside the main mounting slot, each of the plurality of locking blocks is hinged inside the first branch mounting slots, the outside of the base seat is configured with a plurality of intercommunicating holes that are both communicated to the first branch mounting slots and the second branch mounting slots, each of the plurality of gear racks goes through the second branch mounting slots, the first teeth part of each of the plurality of gear racks is exposed inside each of the plurality of intercommunicating holes, and the cover plate covers an upper end of each of the plurality of gear racks, the upper end of each of the plurality of support legs is hinged inside each of the plurality of intercommunicating holes through a pin shaft, a bottom of the main mounting slot is further configured with a sink slot, the spring is installed inside the sink slot.

7. The folding frame defined in claim 1, wherein the number of the plurality of support legs is four, each of the plurality of support legs is hinged with one of the plurality of extension support bars, and each of the plurality of support legs has a containing groove to contain one of the plurality of extension support bars when retracted.

8. An outdoor chair, comprising:

a folding frame and a chair cloth configured on an upper end of the folding frame, wherein the folding frame includes a base, a plurality of support legs hinged around the base, a plurality of extension support bars hinged on the plurality of support legs and capable of folding in relation to the plurality of support legs, a locking mechanism mounted within the base that can lock the plurality of support legs when unfolded, and a plurality of gear racks fitted inside the base, each of the plurality of gear racks is configured with vertically distributed first teeth part on both sides, an upper end of each of the plurality of support legs is configured with circularly distributed second teeth part on both sides, the upper end of each of the plurality of support legs is positioned between two of the plurality of gear racks, the second teeth part on each of the plurality of the support legs engages with the first teeth part of the plurality of gear racks, each of the plurality of support legs can be folded and unfolded independently in relation to the base, the number of the plurality of support legs is four, the number of the plurality of extension support bars is four, with two extension support bars being of greater length compared to two extension support bars of lesser length, the chair cloth is in the shape of a hopper, and four corners of the chair cloth are respectively connected to and fixed with upper ends of the four extension bars;

wherein the section of each of the plurality of gear racks is in the shape of a right angle, wherein the locking mechanism comprises a pull rod mounted inside the base, capable of moving up and down, a spring sheathed outside the pull rod and abutting the base, and a plurality of locking blocks hinged inside the base and flexibly connected to an outside of an upper end of the pull rod, the pull rod can be pushed upward under an elastic force of the spring, to force an end portion of each of the plurality of locking blocks into lock slot on the upper end of each of the plurality of support legs, so as to provide fixation support to the plurality of support legs unfolded in relation to the base, a lower end of the pull rod can be extended out of a lower end face of the base, by pulling the pull rod downward to force each of the plurality of locking blocks to leave the lock slot on the upper end of each of the plurality of support legs, the locking can be released.

9. The outdoor chair defined in claim 8, wherein both sides of each of the plurality of locking blocks are formed with a round convex column, and each of the plurality of locking blocks is hinged with the base through the round convex columns, and can swing up and down inside the base, the lower end of the pull rod is configured with a flexible pull ring, the lower end face of the base is configured with sphere surface slots, an upper end of the pull ring is configured inside the sphere surface slots, and abuts the sphere surface slots.

10. The outdoor chair defined in claim 9, wherein the end portion of each of the plurality of locking blocks is configured with a hinge slot, and the two sides of each of the plurality of locking blocks are configured with a slide bar hole that goes through the hinge slot, the outside of the upper end of the pull rod is configured with a plurality of hinge portions, a side face of each of the plurality of hinge portions is configured with a through axle hole, each of the plurality of hinge portions is mounted inside the hinge slot on the end portion of each of the plurality of locking blocks, the axle hole of each of the plurality of hinge portions is fitted with a shaft, an end portion of the shaft goes into the slide bar hole, and can slide inside the slide bar hole.

11. The outdoor chair defined in claim 8, wherein the base comprises a base seat and a cover plate covering the base seat, the base seat is configured with a main mounting slot extending from the base seat's upper end face downward for mounting the pull rod and a plurality of first branch mounting slots and second branch mounting slots located outside the main mounting slot, the pull rod is fitted inside the main mounting slot, each of the plurality of locking blocks is hinged inside the first branch mounting slots, the outside of the base seat is configured with a plurality of intercommunicating holes that are both communicated to the first branch mounting slots and the second branch mounting slots, the plurality of gear racks goes through the second branch mounting slots, the first teeth part of the plurality of gear rack is exposed inside each of the plurality of intercommunicating holes, and the cover plate covers the upper end of each of the plurality of gear racks, the upper end of each of plurality of the support legs is hinged inside each of the plurality of intercommunicating holes through a pin shaft, a bottom of the main mounting slot is further configured with a sink slot, the spring is installed inside the sink slot.

12. An outdoor table, comprising:

a folding frame and a table cloth configured on the upper end of the folding frame, wherein the folding frame includes a base, a plurality of support legs hinged around the base, a plurality of extension support bars hinged on the plurality of support legs and capable of folding in relation to the plurality of support legs, a locking mechanism mounted within the base that can lock the plurality of support legs when unfolded, and a plurality of gear racks are fitted inside the base, each of the plurality of gear racks is configured with vertically distributed first teeth part on both sides, the upper end of the support leg is configured with circularly distributed second teeth part on both sides, the upper end of the support leg is positioned between two of the plurality of gear racks, the second teeth part of the support leg mesh with the first teeth part of the plurality of gear racks, each support leg can be folded and unfolded independently in relation to the base; the number of the plurality of support legs is four, the number of the extension support bars is four, and the lengths of the extension support bars are the same, four corners of the table cloth are respectively connected to and fixed with upper ends of the four extension bars through connecting blocks;

wherein the section of each of the plurality of gear racks is in the shape of a right angle, wherein the locking mechanism comprises a pull rod mounted inside the base, capable of moving up and down, a spring sheathed outside the pull rod and abutting the base, and a plurality of locking blocks hinged inside the base and flexibly connected to the outside of an upper end of the pull rod, the pull rod can be pushed upward under an elastic force of the spring, to force an end portion of each of the plurality of locking blocks into lock slot on the upper end of each of the plurality of support legs, so as to provide fixation support to the plurality of support legs unfolded in relation to the base, a lower end of the pull rod can be extended out of a lower end face of the base, by pulling the pull rod downward to force each of the plurality of locking blocks to leave the lock slot on the upper end of each of the plurality of support legs, the locking can be released.

13. The outdoor table defined in claim 12, wherein both sides of each of the plurality of locking blocks are formed with a round convex column, and each of the plurality of locking blocks is hinged with the base through the round convex columns, and can swing up and down inside the base, the lower end of the pull rod is configured with a flexible pull ring, the lower end face of the base is configured with sphere surface slots, an upper end of the pull ring is configured inside the sphere surface slots, and abuts the sphere surface slots.

14. The outdoor table defined in claim 13, wherein the end portion of each of the plurality of locking blocks is configured with a hinge slot, and the two sides of each of the plurality of locking blocks are configured with a slide bar hole that goes through the hinge slot, the outside of the upper end of the pull rod is configured with a plurality of hinge portions, a side face of each of the plurality of hinge portions is configured with a through axle hole, each of the plurality of hinge portions is mounted inside the hinge slot on the end portion of each of the plurality of locking blocks, the axle hole of each of the plurality of hinge portions is fitted with a shaft, an end portion of the shaft goes into the slide bar hole, and can slide inside the slide bar hole.

15. The outdoor table defined in claim 12, wherein the base comprises a base seat and a cover plate covering the base seat, the base seat is configured with a main mounting slot extending from the base seat's upper end face downward for mounting the pull rod and a plurality of first branch mounting slots and second branch mounting slots located outside the main mounting slot, the pull rod is fitted inside the main mounting slot, each of the plurality of locking blocks is hinged inside the first branch mounting slots, the outside of the base seat is configured with a plurality of intercommunicating holes that are both communicated to the first branch mounting slots and the second branch mounting slots, the plurality of gear racks goes through the second branch mounting slots, the first teeth part of the plurality of gear racks is exposed inside the hole, and the cover plate covers the upper end of each of the plurality of gear racks, the upper end of each of the plurality of support legs is hinged inside the hole through a pin shaft, a bottom of the main mounting slot is further configured with a sink slot, the spring is installed inside the sink slot.

* * * * *